US005456310A

United States Patent [19]

Brophy et al.

[11] Patent Number: 5,456,310

[45] Date of Patent: Oct. 10, 1995

[54] ROTARY REGENERATIVE HEAT EXCHANGER

[75] Inventors: Mark E. Brophy; Wayne S. Counterman, both of Wellsville, N.Y.

[73] Assignee: ABB Air Preheater, Inc., Wellsville, N.Y.

[21] Appl. No.: 286,781

[22] Filed: Aug. 5, 1994

[51] Int. Cl.[6] ..... F23L 15/02

[52] U.S. Cl. ..... 165/9; 165/10

[58] Field of Search ..... 165/9, 10

[56] References Cited

U.S. PATENT DOCUMENTS

| | | | |
|---|---|---|---|
| 3,380,514 | 4/1968 | Eisenstein | 165/9 |
| 3,830,287 | 8/1974 | Eisenstein | 165/9 X |
| 4,593,750 | 6/1986 | Finnemore | 165/9 |
| 5,048,595 | 9/1991 | Harder | 165/9 |

*Primary Examiner*—John Rivell
*Assistant Examiner*—Christopher Atkinson
*Attorney, Agent, or Firm*—Chilton, Alix & Van Kirk

[57] ABSTRACT

A rotary regenerative air preheater has a rotor which is divided into sectors by diaphragm plates. Mounted between these diaphragms are support gratings which support the heat exchange baskets with there being at least two circumferentially adjacent full-wrapper baskets on each support grating. The gratings include radial seals which extend axially into the spaces between these adjacent baskets to provide a seal to minimize circumferential fluid flow. Attached to the radial seals at the axial ends of the rotor are seal strips which form a seal with the sector plates on the rotor housing thereby forming a double seal to minimize cross flow between the gas side and the air side.

5 Claims, 2 Drawing Sheets

ROTARY REGENERATIVE HEAT EXCHANGER

BACKGROUND OF THE INVENTION

The present invention relates generally to rotary heat exchangers and, more specifically, to improved means for supporting modular heat exchange baskets and providing double radial seals.

A rotary regenerative heat exchanger is employed to transfer heat from one hot gas stream, such as a flue gas stream, to another cold gas stream, such as combustion air. The rotor contains a mass of heat absorbent material which is first positioned in a passageway for the hot gas stream where heat is absorbed by the heat absorbent material. As the rotor turns, the heated absorbent material enters the passageway for the cold gas stream where the heat is transferred from the absorbent material to the cold gas stream.

In a typical rotary heat exchanger, such as a rotary regenerative air preheater, the cylindrical rotor is disposed on a central rotor post and divided into a plurality sector-shaped compartments by a plurality of radial partitions or diaphragms extending from the rotor post to the outer peripheral shell of the rotor. These sector shaped compartments are loaded with modular heat exchange baskets which contain the mass of heat absorbent material commonly comprised of stacked plate-like elements.

The rotor is surrounded by a housing and the ends of the rotor are partially covered by sector plates located between the gas inlet and outlet ducts which divides the housing into hot gas and cold gas sides. In order to improve the efficiency of operation, it is conventional to provide seals, which are referred to as radial seals, on the ends of the rotor such that the seals will come into proximity with the sector plates and minimize the flow of gases between the hot and cold sides at the ends of the rotor. These seals are normally attached to the edges of the diaphragms. It is often desirable to have double seals which means that there are two spaced seals in engagement with the sector plates at all times. However, this would require the use of an excessive number of diaphragms to which the seals are attached and which isolate one sector from the adjacent sector. For example, there might be double the number of diaphragms which adds considerable weight and cost to the rotor.

The conventional modular heat exchange basket comprises an open frame and does not have solid side walls. These baskets are loaded axially into the rotor from the ends and stay plates are located between and support radially adjacent baskets. To ensure that the baskets can be freely inserted, it is necessary to have the baskets undersized as compared to the compartments formed by the diaphragms and stay plates so that there is a clearance. Therefore, in order to provide the necessary heat exchange surface, it is necessary to have excess frontal area and consequently a larger rotor.

SUMMARY OF THE INVENTION

The present invention relates to novel means for supporting heat exchange baskets in a rotary regenerative heat exchange in a manner to provide a greater number of radial seals without the necessity for a greater number of full size radial partitions or diaphragms. More specifically, fully wrapped baskets are supported on gratings fixed between diaphragms at each end of the rotor and between layers of baskets. The gratings include radial seals to seal between each layer and to form seals with the sector plates. By this arrangement, more seals are provided without the need for additional diaphragms and double seals with the sector plates are more feasible.

DESCRIPTION OF THE PREFERRED EMBODIMENT

Figure 1:
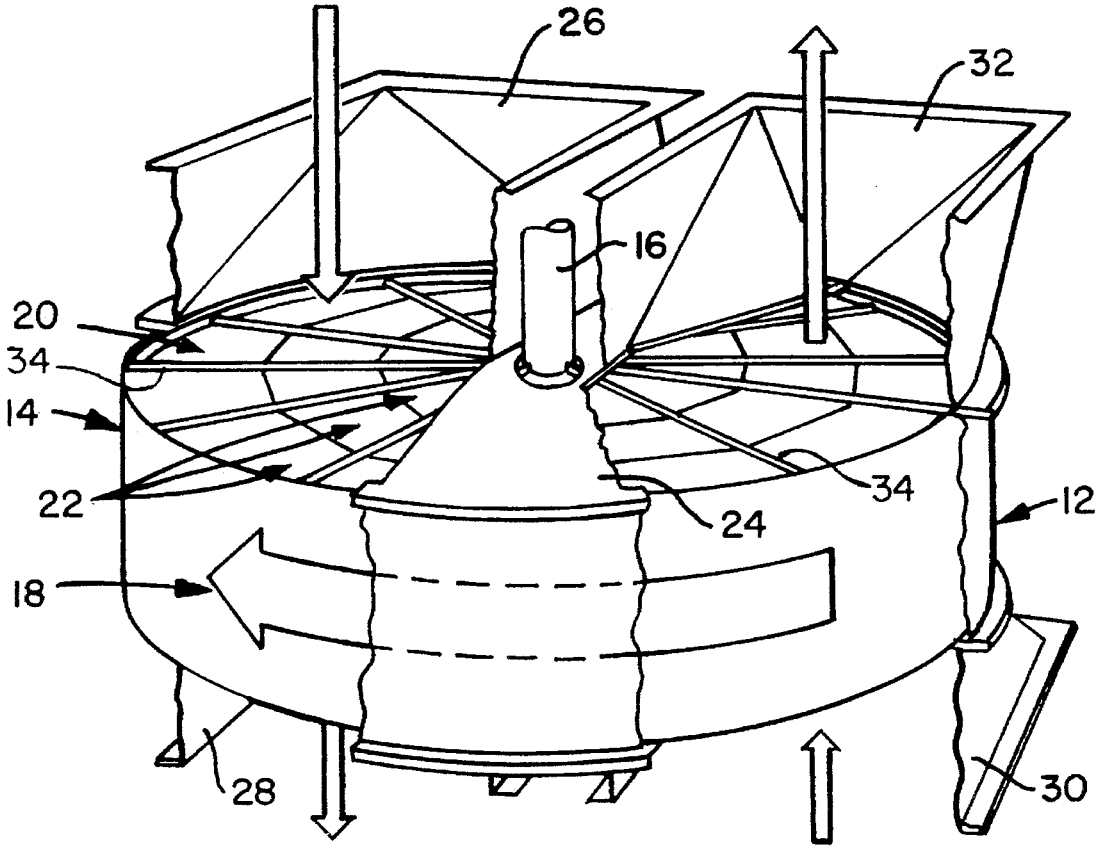
FIG. 1 is a general perspective view of a rotary regenerative air preheater.

FIG. 1 of the drawings is a partially cut-away perspective view of a typical air heater showing a housing 12 in which the rotor 14 is mounted on drive shaft or post 16 for rotation as indicated by the arrow 18. The rotor is composed of a plurality of sectors 20 with each sector containing a number of basket modules 22 and with each sector being defined by the diaphragms 34. The basket modules contain the heat exchange surface. The housing is divided by means of the flow impervious sector plate 24 into a flue gas side and an air side. A corresponding sector plate is also located on the bottom of the unit. The hot flue gases enter the air heater through the gas inlet duct 26, flow through the rotor where heat is transferred to the rotor and then exit through gas outlet duct 28. The countercurrent flowing air enters through air inlet duct 30, flows through the rotor where it picks up heat and then exits through air outlet duct 32.

Figure 2:
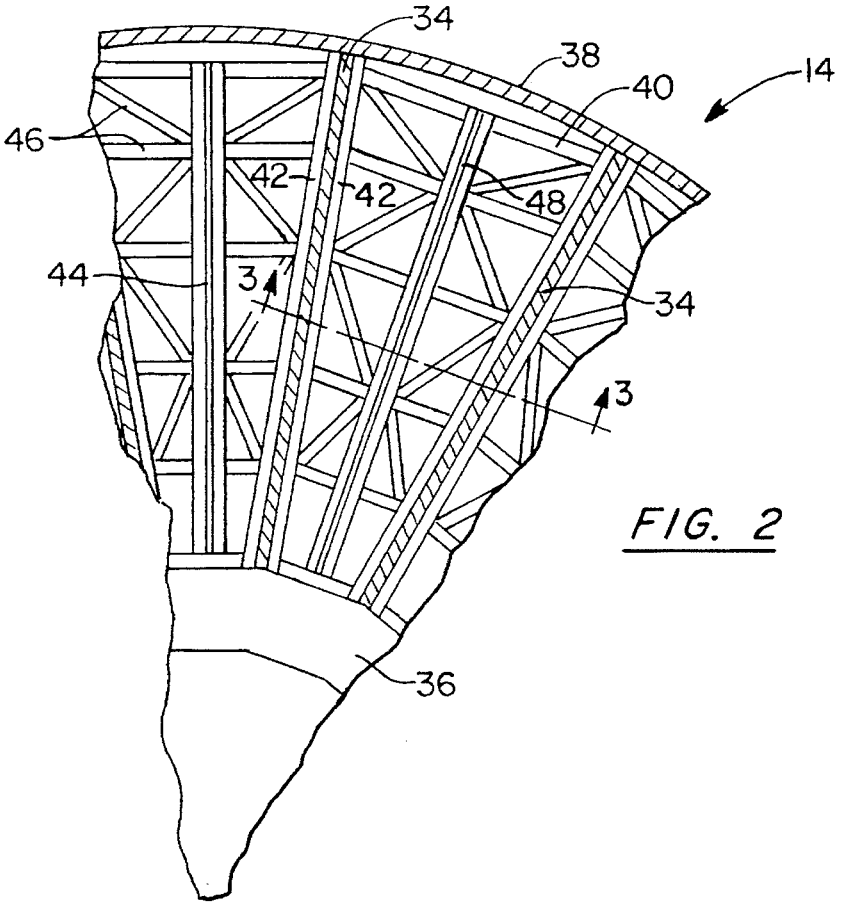
FIG. 2 is a top cross section view of a portion of the rotor of the preheater of FIG. 1 illustrating the support gratings in position between diaphragms.

Referring now to FIG. 2 which shows a plan view in cross section of a portion of a rotor, the diaphragms 34 are shown in cross section extending radially between the central portion 36 of the rotor and the rotor shell 38. This FIG. 2 is a view before the basket modules have been installed. Supported between and attached to the diaphragms 34 are the support gratings 40 of the present invention. As illustrated in this FIG. 2, the support gratings of a truss structure including the side bars or rails 42, a central bar 44 and the various cross members 46. Any desired truss configuration can be used as long as it is structurally designed for the load.

Figure 3:
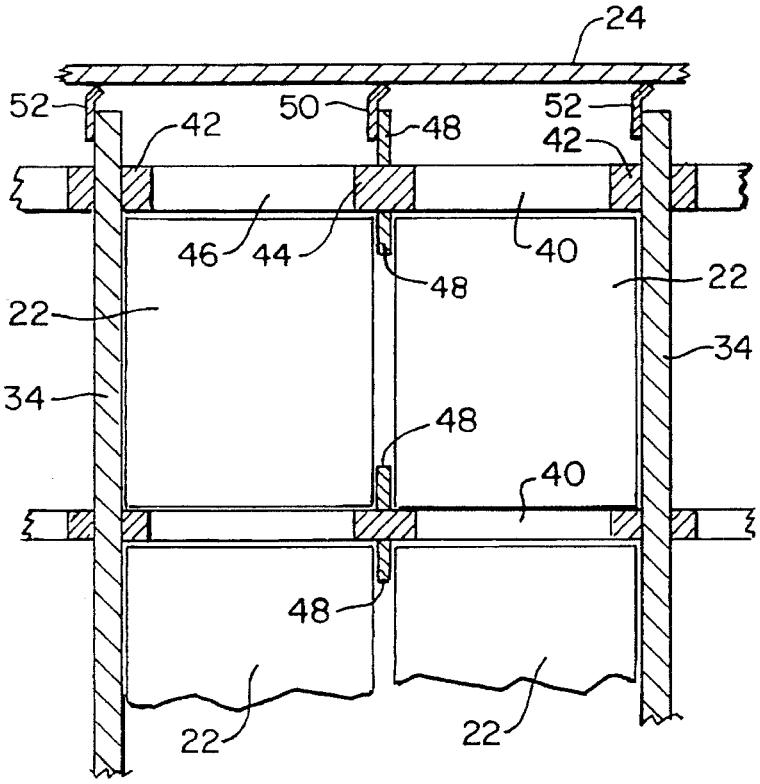
FIG. 3 is a cross section view of a portion of one sector taken generally along line 3—3 of FIG. 2.

As shown in FIG. 3, a support grating 40 is located between each layer of the baskets 22 as well as at the top and bottom (not shown). The gratings are suitably attached to the diaphragms 34 such as by welding.

Attached to the top and the bottom of the central bar 44 of each support grating are the seals 48 which run radially along these bars. As seen in FIG. 3, these radial seals extend into the spaces between adjacent baskets 22.

The baskets which are employed with the present invention are of the full-wrapper type. This means that all sides of each individual basket are covered with solid sheet metal with only the top and bottom ends being open for fluid flow. The combination of the full-wrapper baskets and the radial seals between adjacent baskets cooperating with the full-Wrapper prevents lateral or circumferential fluid flow between adjacent sectors. As can be readily seen in FIG. 3, an effective seal has been provided with only half the number of full-depth diaphragms 34 that would otherwise be required. The elimination of half the diaphragms reduces the weight of the rotor considerably.

Another aspect of the invention is that the baskets are placed into the rotor through the sides or the periphery of the rotor rather than from the top end of the rotor. When baskets are loaded from the top, sufficient clearance must be provided and stayplates are located between radially adjacent baskets to hold them in place. The clearance around each basket means that the air preheater will have excess frontal (end) area in order to accommodate a certain amount of heat transfer surface. When the baskets are loaded from the side, very little clearance is needed and they can be fitted tightly into the sections and against each other so that most clearances are eliminated. This eliminates the need for stayplates and reduces the frontal area of the air preheater.

Also shown in FIG. 3 is the double sealing aspect of the present invention. Mounted on the radial seals 48 at both the top and bottom ends of the rotor are the sealing strips 50 which run the full length of the radial seals.

Sealing strips 52 are also mounted on the top and bottom edge of the diaphragms 34. These sealing strips 50 and 52 are flexible members which cooperate with the sector plate 24 to form a seal and minimize fluid flow between the gas and air sides of the air preheater. As can be seen in FIG. 3, at least two of these seal strips engage the sector plate at any particular time thereby creating a sealed plenum between the gas and air sides. An example of a seal strip which could be employed is disclosed in U.S. Pat. No. 4,593,750.

We claim:

1. A rotor assembly for a vertical shaft rotary regenerative heat exchanger, said heat exchanger including a cylindrical housing surrounding said rotor and sector plates at opposite ends of said cylindrical housing providing flow impervious portions located between flow inlet and outlet openings on each end of said housing, said rotor assembly mounted on an axially extending rotor shaft and comprising:

a. diaphragms extending radially in said rotor assembly essentially from the center to the periphery of said rotor and from the top to the bottom thereof so as to divide said rotor into a plurality of sector-shaped compartments;

b. a plurality of axially spaced horizontally extending support gratings located in each sector-shaped compartment mounted between said diaphragms, said support gratings being an open structure to permit fluid flow axially therethrough;

c. a plurality of full-wrapped heat exchange baskets supported on each support grating with at least two of said baskets located circumferentially adjacent each other; and d. radial seal means mounted on said support grating and extending axially between said circumferentially adjacent basket to form a fluid flow seal to maintain fluid flow axially through said baskets and minimize circumferential fluid flow.

2. A rotor assembly as recited in claim 1 wherein said plurality of axially spaced horizontally extending support grating includes support gratings located at the axial ends of each sector shaped compartment and at least one support grating between said support gratings at the axial ends.

3. A rotor assembly as recited in claim 2 wherein said support gratings at the axial ends include radial seal means extending axially outward so as to sealingly cooperate with said sector plates to minimize circumferential fluid flow.

4. A rotor assembly as recited in claim 1 wherein each support grating includes a radially extending grate member located midway between said diaphragms plates and wherein said radial seal means are mounted on said radially extending grate member.

5. A rotor assembly as recited in claim 4 wherein said radial seal means are mounted both on the top and bottom of each radially extending grate member.

* * * * *

UNITED STATES PATENT AND TRADEMARK OFFICE

CERTIFICATE OF CORRECTION

PATENT NO. : 5,456,310
DATED : October 10, 1995
INVENTOR(S) : Brophy et al.

It is certified that error appears in the above-indentified patent and that said Letters Patent is hereby corrected as shown below:

In claim 4, column 4, line 29, delete "plates".

Signed and Sealed this

Twenty-ninth Day of October 1996

*Attest:*

Bruce Lehman

BRUCE LEHMAN

*Attesting Officer*

*Commissioner of Patents and Trademarks*